US009821243B2

(12) United States Patent
Shestak et al.

(10) Patent No.: US 9,821,243 B2
(45) Date of Patent: Nov. 21, 2017

(54) NODE OF INDIVIDUAL MOVING ELEMENTS OF MECHANICAL MODEL AND METHOD FOR CONNECTING MOVING ELEMENTS ROTATING AROUND ONE AXIS

(71) Applicant: TOVARYSTVO Z OBMEZHENOIU VIDPOVIDALNISTIU "UKRAINIAN GEARS", Kyiv (UA)

(72) Inventors: Gennadii Anatoliiovych Shestak, Kyivska oblast (UA); Denys Viktorovish Okhrimenko, m.Sumy (UA)

(73) Assignee: TOVARYSTVO Z OBMEZHENOIU VIDPOVIDALNISTIU "UKRAINIAN GEARS", Kyiv (UA)

( * ) Notice: Subject to any disclaimer, the term of this patent is extended or adjusted under 35 U.S.C. 154(b) by 0 days.

(21) Appl. No.: 15/117,481

(22) PCT Filed: Mar. 16, 2015

(86) PCT No.: PCT/UA2015/000018

§ 371 (c)(1),
(2) Date: Aug. 9, 2016

(87) PCT Pub. No.: WO2016/076816

PCT Pub. Date: May 19, 2016

(65) Prior Publication Data

US 2017/0246550 A1 Aug. 31, 2017

(30) Foreign Application Priority Data

Nov. 11, 2014 (UA) ..... A 201412185

(51) Int. Cl.
*A63H 17/26* (2006.01)
*A63H 33/04* (2006.01)
(Continued)

(52) U.S. Cl.
CPC ..... *A63H 33/042* (2013.01); *A63H 17/264* (2013.01); *A63H 33/107* (2013.01); *A63H 33/108* (2013.01); *A63H 33/12* (2013.01)

(58) Field of Classification Search
CPC .... A63H 17/002; A63H 17/26; A63H 17/264; A63H 33/04; A63H 33/042; A63H 33/08; A63H 33/10
(Continued)

(56) References Cited

U.S. PATENT DOCUMENTS 3,236,004 A * 2/1966 Christiansen ..... A63H 33/042 384/420
3,638,352 A * 2/1972 Christiansen ..... A63H 33/042 301/112
(Continued)

FOREIGN PATENT DOCUMENTS

CN 102553263 A 7/2012
RU 2118195 C1 8/1998

*Primary Examiner* — Alexander Niconovich
(74) *Attorney, Agent, or Firm* — Nadya Reingand; Yan Hankin

(57) ABSTRACT

The invention relates to producing kits for games and souvenirs. The invention consists in a node for connecting moving elements thereof in order to perform a connecting action using two groups of components. A first group of components and a second group of components are connected by means of inserting protrusions, which are positioned along opposing edges of at least two individual components of the second group, in at least two rectangular connecting apertures of one of the individual components of the first group, and which are disposed symmetrically relative to a central aperture on each of the individual components of the first group. The second group of components contains at least two individual components which are made in the form of symmetrical pairs. The result consists in the fastest and most-reliable assembly of the node.

10 Claims, 11 Drawing Sheets

(51) Int. Cl.
*A63H 33/10* (2006.01)
*A63H 33/12* (2006.01)

(58) Field of Classification Search
USPC ..... 446/85, 102, 103, 120, 128
See application file for complete search history.

(56) References Cited

U.S. PATENT DOCUMENTS 4,078,328 A * 3/1978 Rayment ..... A63H 33/108
446/102
5,071,384 A * 12/1991 Poulsen ..... A63H 17/36
446/103
5,094,643 A * 3/1992 Bolli ..... A63H 33/04
403/348
5,259,803 A * 11/1993 Lyman ..... A63H 31/00
446/103
5,346,420 A * 9/1994 Glickman ..... A63H 33/042
446/124
5,890,943 A * 4/1999 Poulsen ..... A63H 33/042
446/103
6,109,997 A * 8/2000 Hatting ..... A63H 33/062
446/103
6,257,086 B1 * 7/2001 Petersen ..... A63H 31/00
74/425
8,568,187 B2 * 10/2013 Norman ..... A63H 33/084
273/156
9,302,196 B2 * 4/2016 Norman ..... A63H 33/084

* cited by examiner

NODE OF INDIVIDUAL MOVING ELEMENTS OF MECHANICAL MODEL AND METHOD FOR CONNECTING MOVING ELEMENTS ROTATING AROUND ONE AXIS

CROSS-REFERENCE TO RELATED APPLICATIONS

The present application is a National stage application from PCT application No. PCT/UA2015/000015 filed on Mar. 16, 2015, which claims priority to Ukrainian patent application a 2014 12185 filed on Nov. 11, 2014.

TECHNICAL FIELD

The invention refers to the production of gaming and souvenir kits, namely, to the unit—the unit (the joint) of separate moving elements of a mechanical model and to the method of connecting the parts of separate moving elements of such a unit of a mechanical model, which are united by a single creative idea. The invention can be used in the composition of the gaming and souvenir sets, constructors, models of which are being built by means of connection, assembly and mounting of separate elements which can be made from a sheet material and connecting elements. Such models can be volumetric models with moving parts, the mechanical 3D-puzzles and other constructions.

BACKGROUND

It is known (it is a prior art) a technical decision "Game Constructor "Marco", which includes a unit of separate moving parts of a mechanical model which are able to rotate about a single axis, which comprises an axis and parts of separate moving elements, connected to each other (Declaration patent of Ukraine for invention JNo. 65775 A, int. class. A63H 33/04, published 15 Apr. 2004, bulletin JSTs 4). This technical decision is intended to simplify the manufacturing of the elements of constructor kit and to reduce the manufacturing costs, however the design features of the units of this useful model don't provide a possibility to carry out the assembly of the unit conveniently and quickly as well as to fix the whole unit rigidly enough without the use of glue or other additional fixation elements and/or substances.

It is known (it is a prior art) a "Product from Toy Constructor" invention, which includes a unit of separate moving parts of a mechanical model which are able to rotate about a single axis which comprises an axis and parts of separate moving elements, connected to each other (Declaration Patent of Russian Federation for invention JTs 2118195, int. class. A63H 33/08, published 27 Aug. 1998). This invention allows to develop complex gear mechanisms and to achieve the variety of speeds and mechanical effects. However such a technical decision doesn't provide opportunity to carry out the assembly of the unit more conveniently and quickly as well as it doesn't provide opportunity to fix the whole unit rigidly enough without the use of glue or other additional fixation elements and/or substances.

The closest unit for the claimed invention is the unit in the "3D (three-dimensional) puzzles blocks for the assembly of the horse model for children" construction. This unit comprises the separate moving elements of a mechanical model, which are able to rotate about a single axis as well as it comprises an axis and parts of separate moving elements connected to each other (Application of the People's Republic of China 201010583761.1 from 12Dec. 2010, int. class. A63H 33/12, published X<<102553263 from 11 Jul. 2012).

This technical decision is intended for tight connection (assembly) of different separate parts into the units and into the whole construction for training and development of children coordination. However, this invention as well as the construction decisions of the elements of its units don't allow to carry out assembly of the unit conveniently and quickly as well as don't allow to fix the whole unit rigidly enough without the use of glue or other additional fixation elements and/or substances.

It is known (it is a prior art) a method of connecting the parts of separate moving elements of a unit of a mechanical model which is described in "Game Constructor "Marco" invention, that envisages a connection of these parts by installing some parts into the connecting holes of other parts and further connection of all parts in a single unit of a mechanical model (Declaration patent of Ukraine for invention Jfe 65775 A, int. class. A63H 33/04, published 15 Apr. 2004, bulletin K 4). This method of connection is used for constructional cross-shaped elements (cross-bars) with connecting cross-shaped elements, and in this way the reliable system of connection of composing elements of constructor is achieved. However, this method doesn't allow to carry out more convenient and rapid assembly of the unit of separate moving elements of a mechanical model, which are able to rotate about a single axis, and herewith doesn't provide possibility for rigid enough fixing of the whole unit without the use of glue or other additional fixation elements and/or substances.

It is known (it is a prior art) a method of connecting the parts of separate elements of a unit of a mechanical model which is described in a "Product from Toy Constructor" invention, which envisages a joint of these parts and further assembly of all parts into a single unit of a mechanical model (Patent of Russian Federation for invention No. 2118195, int. class. A63H 33/08 published 27 Aug. 1998). This method of connection of the parts is implemented by operations of hooking, clamping, inserting one part into another, as well as by the use of clamping levers of other parts. This method doesn't provide possibility for more convenient and faster assembly of the unit of separate moving elements of a mechanical model, which are able to rotate about a single axis, and herewith doesn't provide possibility for rigid enough fixing of the whole unit without the use of glue or other additional fixation elements and/or substances.

The closest unit for the claimed method of connection is the method described in the "3D (three-dimensional) puzzles blocks for the assembly of the horse model for children" invention, which envisages a joint between each other by inserting some parts into the connecting holes of other parts and further connections of all parts into a single unit of a mechanical model (Application of the People's Republic of China 201010583761.1 from 12.12.2010, int. class. A63H 33/12, publication No. 102553263 from 11 Jul. 2012). This method of connecting the parts of separate moving elements of the unit of a mechanical model, which are able to rotate about a single axis, envisages the connection of parts between each other by inserting some parts into the connecting holes of other parts and further fixing all parts into the single unit of a mechanical model. However, embodiment of such connection of some parts with other parts by means of connecting holes of these parts through the rods, which allow to make the elements of constructor movable, don't provide possibility for more convenient and faster assembly of the unit as well as for rigid fixing the whole unit without the use of glue or other additional fixation elements and/or substances.

Background of the invention is the task to create a unit of moving elements of a mechanical model which are able to rotate about a single axis, construction of which by means of new features, namely by introduction of new elements, new shapes and their mutual arrangement, would allow to carry out assembly of the unit more conveniently and quickly and herewith fix the whole unit rigidly enough without the use of glue or other additional fixation elements and/or substances.

Background of the invention is also the task to create a method of connecting parts of separate moving elements of the unit of a mechanical model, which are able to rotate about a single axis, which by means of new technological operations, their sequences, operations for ensuring and implementation of the particular interconnection of the unit's parts, including by means of wedging process, would allow to carry out more convenient and quick assembly of the unit and herewith fix the whole unit rigidly enough without the use of glue or other additional fixation elements and/or substances.

SUMMARY

The task is solved in that the unit of separate moving elements of a mechanical model, which are able to rotate about a single axis, comprises the axis, the separate moving elements and parts of such moving elements, connected between each other. Novelty consists in that the unit comprises the first group of parts and the second group of parts, herewith the first group of parts comprises no less than two separate parts and each of these separate parts of the first group comprises the central hole for inserting the axis into it. Beside this, each of no less than two separate parts of the first group comprises no less than two rectangular connecting holes, which are disposed symmetrically in relation to the center hole on each of the separate parts of the first group. The second group of parts comprises no less than two separate parts, which are pairwise symmetric, and each of these separate parts of the second group comprises protrusions at the opposite edges. Besides this, each of these separate parts of the second group comprises no less than one central protrusion in the central section. Herewith, the first group and the second group of parts are interconnected by means of separate parts of the second group, which are pre-grouped and form a central axial clearance between the central protrusions of these separate parts of the second group. During connecting the parts of the first and second groups, the protrusions, disposed on one side at the edges of separate parts of the second group, are inserted into no less than two rectangular connecting holes of one of the separate parts of the first group, and other protrusions, which are disposed from the other side at the edges of separate parts of the second group, are inserted into no less than two rectangular connecting holes of the other separate part of the first group. The axis is inserted into a central hole of one of the separate parts of the first group and into a central axial clearance formed between the central protrusions of the separate parts of the second group, as well as into a central hole of the other separate part of the first group.

For some embodiment, the claimed unit is characterizes by the following features which develop and clarify the set of features of the independent claim.

Each of the separate parts of the first group comprises three rectangular connecting holes, which are disposed symmetrically in relation to the center hole on each of the separate parts of the first group, and the second group of parts comprises three separate parts, each of which comprises protrusions at the ends of the parts, as well as each of these separate parts of the second group comprises no less than one central protrusion in the central section.

Each of the separate parts of the first group comprises four rectangular connecting holes, which are disposed symmetrically in relation to the center hole on each of the separate parts of the first group, and the second group of parts comprises four separate parts, each of which comprises protrusions at the ends of the parts, as well as each of these separate parts of the second group comprises no less than one central protrusion in the central section.

The axis has circular cross-section and has sharpened ends.

The parts of the first group and the second group are made from the material which has a higher material resistance than the material from which the axis is made.

Fixation protrusions are made at the ends of each of the separate parts of the second group.

The longitudinal slots, which are disposed along the axis line of the unit, are made on the protrusions of each of the separate parts of the second group.

The task is solved in that, the method of connecting parts of separate moving elements of the unit of a mechanical model, which are able to rotate around a single axis, provides the connection of the parts to each other by means of installing parts into the connecting holes of other parts, and the further fixing all parts into a single unit of a mechanical model. Novelty consists in that the connecting operations are carried out with the use of axis and two groups of parts. The connection of the first group of parts and the second group of parts is carried out by inserting the protrusions, which are disposed at the opposite edges of no less than two separate parts of the second group, into no less than two rectangular connecting holes of one of the separate part of the first group, as well as other protrusions, which are disposed at the other—opposite edges of no less than two separate parts of the second group, are inserted into no less than two rectangular connecting holes of other separate part of the first group. Herewith, a central axial clearance is formed between the central protrusions of the separate parts of the second group. After this the axis is inserted into a central hole of one of the separate parts of the first group, as well as into a central axial clearance formed between the central protrusions of the separate parts of the second group, as well as into a central hole of another separate part of the first group. The parts of the second group are wedged by means of the axis in all directions perpendicularly to the axis, with simultaneous fixing the axis and all parts of the first and second group into a single unit.

For some embodiment, the claimed unit is characterizes by the following features which develop and clarify it.

Connecting and fixing parts of the first group and the parts of the second group into a single unit is additionally strengthened and provided by means of hooking the edges of no less than two connecting holes of the parts of the first group with fixation protrusions that are disposed at the ends of each of the separate parts of the second group.

The use of the longitudinal slots on the protrusions of each of the separate parts of the second group assures tightness of connection of separate parts of the second group with separate parts of the first group.

INVENTIVE STEP (INVENTIVENESS, NON-OBVIOUSNESS)

The construction of the claimed unit of separate moving elements of a mechanical model which are able to rotate about a single axis and the claimed method of connecting the parts of this unit are united by a single creative idea and allow to achieve the posed technical task: the claimed method of connecting the parts of separate moving elements of the claimed unit of a mechanical model can be used only with such unit of moving elements of a mechanical model, which are able to rotate about a single axis, and respectively such unit determines the implementation of the process of connecting its parts in accordance with the claimed method.

The set of all the substantial features of the claimed unit, including its new substantial features, allow to assure achievement of the technical result, namely—to carry out assembly of the unit more conveniently and quickly and herewith fix the whole unit rigidly without the use of glue or other additional fixation elements and/or substances.

New features of the claimed unit allow to achieve the technical result: owing to the presence, shape and mutual arrangement of no less than two separate parts 3, 4, 5 (e.g. 3, 4 or 3, 4, 5) of the first group 1 with the central holes 6 for inserting the axis 7 into them and no less than two separate parts 12, 13, 14, 15 (e.g. 12, 13 or 12, 13, 14, 15) of the second group 2, which are pairwise symmetric, at their connection with each other and with axis 7, which is carried out in such a way that, during the assembly and pre-grouping of no less than two separate parts 12, 13, 14, 15 (e.g. 12, 13 or 12, 13, 14, 15) of the second group 2 a central axial clearance 21 is formed between the central protrusions 18 of the parts of the second group 2, in the result of connection of all parts of the unit the axis 7 is installed in the central holes 6 of the parts 3, 4 (e.g. 3, 4 or 3, 4, 5) of the first group of parts 1 freely and without resistance, and after the completion of unit assembly the axis 7 becomes clamped in the central axial clearance 21 formed between the central protrusions 18 of the parts of the second group 2.

The presence and shape of no less than two rectangular connecting holes 8, 9, which are disposed symmetrically in relation to the center hole 6 on each of no less than two separate parts 3, 4, 5 (e.g. 3, 4 or 3, 4, 5) of the first group, in a set with the presence and shape of protrusions 16, 17, which are disposed at the edges of no less than two separate parts 12, 13, 14, 15 (e.g. 12, 13 or 12, 13, 14, 15) of the second group 2, allow to carry out assembling and fixing the parts of the first and the second group conveniently and quickly.

The disposition of the axis 7 in the center of the unit is ensured through assembling, fixing and "centering" separate parts 12, 13, 14, 15 of the second group of parts 2 in the rectangular connecting holes 8, 9 of separate parts 3, 4, 5 of the first group of parts 1. Thereby, the presence, shape and mutual arrangement of parts 3, 4, 5 of the first group, parts 12, 13, 14, 15 of the second group 2 and the axis 7 allow to carry out the assembly of the unit more conveniently and quickly and herewith fix the whole unit rigidly enough without the use of glue or other additional fixation elements and/or substances.

In certain embodiments of the construction of the claimed invention, the axis 7 has circular cross-section and has sharpened ends, and in these cases after the final assembly of the unit, the axis 7 may not touch the central holes 6 of the parts 3, 4, 5 of the first group of parts 1, and the axis 7 can be fixed only in the central axial clearance 21. Owing to that the axis 7 can have circular cross-section and the inner planes of the central protrusions 18 of separate parts 12, 13, 14, 15 of the second group of the parts 2 have a smooth surface, the power of"pricking" friction when inserting the axis 7 into the formed central axial clearance 21 is the minimum that allows to enhance the achievement of the technical result—to carry out the assembly of the unit more conveniently and quickly.

During the assembly of the unit, the centering of the axis 7 in relation to the central holes 6 of the separate parts 3, 4, 5 of the first group of parts 1 is ensured by no less than two separate parts from the parts 12, 13, 14, 15 (e.g. 12, 13 or 12, 13, 14, 15) of the second groups of parts 2 which are centered "independently" during the connection and are attached to the edges of rectangular connecting holes 8, 9, 10, 11 of separate parts 3, 4, 5 of the first group of parts 1. Also during the equivalent wedging by the axis 7 no less than two separate parts from the parts 12, 13, 14, 15 (e.g. 12, 13 or 12, 13, 14, 15) of the second group of parts 2 ensure the superposition of all central holes 6 of the parts 3, 4, 5 of the first group of parts 1 and the central axial clearance 21, and the axis 7 itself ensures the alignment of these separate parts 12, 13, 14, 15 of the second group of parts 2 in a position in which they are parallel to each other, as well as the axis 7 ensures the steady wedging of the parts 12, 13, 14, 15 of the second group 2 at opposite edges of the unit.

It turned that the inventiveness of the claimed invention is also in that the parts of the unit in pre-assembled, but not fixed condition, ensure steady centered area (corridor) for installing the axis 7 into it, and the axis 7 during its insertion into the holes 6 and into the axial clearance 21 "aligns" the unit in assembly and center the central holes 6 and central axial clearance 21, as well as fix the whole assembled construction of the unit, and herewith the axis 7 interacts tangentially with the small part of its surface with small part of the surface of the central protrusions 18 of separate parts 12, 13, 14, 15 of the second group of parts 2 of the unit. Herewith during the insertion of the axis 7 into the central axial clearance 21 of the unit, the central protrusions 18 on the separate parts 12, 13, 14, 15 of the second group of parts 2 direct the movement of the axis 7 in two directions allowing the user without special skills easy "stretch" the axis 7 through several central holes 6 of separate parts 3, 4, 5 of the first group of parts 1 simultaneously, that in a result allows to achieve the technical result—to carry out the assembly of the unit more conveniently and quickly and to fix the whole unit rigidly enough without the use of glue or other additional fixation elements and/or substances.

It turned that the inventiveness of the claimed invention is also in that the minimum spot of contact of axis 7 with central protrusions 18 on separate parts 12, 13, 14, 15 of the second group of parts 2 and "the axial corridor" (the axial space), namely the central axial clearance 21, formed by central protrusions 18 on separate parts 12, 13, 14, 15 of the second group of parts 2, allow easily insert the axis 7, notwithstanding possible unevenness of the surface of the axis 7, unevenness of the material of the axis 7 and other parts of the unit, micro-bulges on the axis 7 and on other parts of the unit, that gives the possibility to carry out the assembly and fixing the unit more conveniently and quickly. This embodiment is not possible in the other prior art (known) constructions, in which during installation of an axis into a rather elongated unit, in which the central holes on several parts are united, this axis has to move through all these holes, adjusting itself to them. In this case, an axis of 10.5 mm diameter has to be made, and this leads to the fact that the precision of manufacturing diameters of holes and axes must be unacceptably high in the mass production of such products and would not allow to achieve the posed technical result.

In the claimed construction of the unit all parts of the first group 1 and the parts of the second group 2 can be cut out (made) from a sheet material with thickness of several millimeters or can be made in another way, in particular by casting or molding. Manufacturing the parts of the unit from wooden material sheet with thickness of several millimeters, for example from plywood, is the most economically and ergonomically reasonable option. The use of other kinds of material for manufacturing the parts of the unit (for example, plastic) is rather expensive as well as it complicates connecting these parts with their possibility and ability to rotate about a single axis.

On practice in order to achieve "movability" of the parts of the unit about a single axis in the most cases of use of the similar units, it is necessary to produce cast parts, use metal axis, carry out the connections by bolts or glue, which leads to complication of the construction, rise in price, as well as it leads to reducing the elements of the construction to the minimum—to 2 mm (e.g. bolts), which is not reasonable and ergonomical for such products and doesn't allow to achieve the posed technical result.

In the claimed construction of the unit the wooden sheet materials are predominantly used for manufacturing the parts and in this case the working diameter of the axis 7 can amount up to 2 mm because when the axis has diameter of 3-4 mm the friction power at both ends of the axis 7 (during rotation of the whole unit on the frame of general construction of the final product which includes this unit) would be so high that lubricants or bearings would need to be used. In the claimed construction of the unit it is possible to use, for example, ordinary wooden toothpick or similar elements, which have circular cross-section and have sharpened ends, as the axis 7. Thereby, the thin axis 7 allows to create a "cascade of gearwheels" from the first group of parts (e.g. as it shown on FIG. 7) and rotate the whole system of such gearwheels easily even at multiple increase of moment arm (arm of force).

The new features of the claimed unit in a set with known features, such as—the presence, shape and mutual arrangement of to the first group of parts 1 and the second group of parts 2 during their connection between each other and with the axis 7—allow "to stretch" a thin axis 7 (e.g. with a diameter of up to 2 mm) through the unit with a large quantity of parts of the first group 1 and parts of the second group of parts, to carry out the alignment of central holes 6, central axial clearance 21, and herewith, the total length may be 20-25 times greater than a diameter of the axis, and thus achieve the technical result—to carry out the assembly of the unit more conveniently and quickly and herewith fix the whole unit rigidly enough without the use of glue or other additional fixation elements and/or substances.

Achievement of the technical result is strengthening in that in some cases each of separate parts of the first group comprises three or four rectangular connecting holes 8, 9, 10, 11, which are pairwise symmetric in relation to the central hole 6 on each of the separate parts of the first group 1, and the second group of parts 2, respectively, comprises three or four separate parts from the parts 12, 13, 14, 15, and each of these separate parts of the second group 2 comprises protrusions 16, 17 at the edges, as well as each of these separate parts of the second group 2 comprises no less than one central protrusion 18 in the central section. le, due to increase of the quantity of connecting holes 8, 9, 10, 11 of the parts of the first group 1 and increase of the quantity of separate parts 12, 13, 14, 15 of the parts of the second group 2, the rigidity and the fixing strength of the whole unit without the use of glue or other additional fixation elements and/or substances is enhanced.

Herewith, in some embodiments of the claimed unit. the increasing rigidity and the fixing strength is achieved in that the fixation protrusions 19, 20 can be disposed at the edges of separate parts 12, 13, 14, 15 of the second group of parts 2, which are hooked to the edges of rectangular connecting holes 8, 9, 10, 11 of the parts 3, 4 of the first group 1, and these fixation protrusions 19, 20 are also attached to the edges of rectangular connecting holes 8, 9, 10, 11 during the wedging of parts of the unit by the axis 7, and thus fix the unit.

In some cases the longitudinal slots 22 (FIG. 9, 10) can be made on the protrusions 16, 17 of separate parts 12, 13, 14, 15 of the second group of parts 2, which are disposed along the axis line of the unit and along each separate part 12, 13, 14, 15 of the second group 2, on which the longitudinal slot 22 is disposed. The longitudinal slot 22 allows the material, from which the separate parts 12, 13, 14, 15 of the second group 2 are made, to amortize better during wedging, i.e. each of these longitudinal slots 22 is reduced maximally during wedging that allows the material of the parts 12, 13, 14, 15 of the second group 2 to pull over to the connecting holes 8, 9, 10, 11 of separate parts 3, 4, 5 of the first group 1 more "softly". The edges of separate parts 12, 13, 14, 15 of the second group 2 are divided into two parts whereby a strip of the material is formed on each of the parts 12, 13, 14, 15 of the second group (one part of each separate parts 12, 13, 14, 15 of the second group of parts 2), which is more flexible—it is thinner, herewith it doesn't break because it is supported by the strip (the second part) of respective separate part 12, 13, 14, 15 of the second group of parts 2, which has bigger thickness. Herewith, due to the longitudinal slots 22 the flexibility of separate parts 12, 13, 14, 15 of the second group 2 is increasing that allows to strengthen the possibility to achieve the technical result.

Also in some embodiments of the unit, the achievement of the technical result is strengthening by that the parts of the first group 1 and the parts of the second group 2 are made from the material which has bigger material resistance than the material of which the axis 7 is made. Herewith the axis 7 can be inserted into the central holes 6 and into the central axial clearance 21 more easily and with less resistance than it is realized in the known (prior art) analogues and a prototype and herewith the effect of wedging of the parts of the unit by the axis 7 is increasing, which also helps to ensure a more convenient and fast assembly of the unit and rigidly enough fixing of the whole unit without the use of glue or other additional fixation elements and/or substance. The set of all substantial feature of the claimed method of connecting the parts of separate moving elements of the unit of a mechanical model which are able to rotate about a single axis, including the new substantial features with the use of this method allows to achieve the technical result namely—to carry out the assembly of the unit more conveniently and quickly and herewith, fix the whole unit rigidly enough without the use of glue or other additional fixation elements and/or substances.

The new features of the claimed method—implementation of connecting with the use of the axis 7, the connecting the first group of parts 1 and the second group of parts between each other by means of inserting protrusions 16, which are disposed at the edges of no less than two parts from separate parts 12, 13, 14, 15 of the second group 2, into no less than two rectangular connecting holes 8, 9, 10, 11 of one of separate parts 3 of the first group 1 and insertion of other protrusions 17, which are disposed at other edges of no less than two parts from separate parts 12, 13, 14, 15 of the second group 2, into no less than two rectangular connecting holes 8, 9, 10, 11 of other separate part 4 and/or 5 of the first group 1 and formation of the central axial clearance 21 between the central protrusions 18 of separate parts 12, 13, 14, 15 of the second group 2 allows to carry out a preliminary fixing of the parts of the unit without the insertion of the axis 7 conveniently and quickly. The preliminary fixing by means of constructive features of the parts of the first group and the parts of the second group before the insertion of the axis 7 is not stable enough. The axis 7 is inserted into the central holes 6 of a part from separate parts 3 of the first group, into the central axial clearance 21 formed between central protrusions 18 of separate parts 12, 13, 14, 15 of the second group 2 and into the central hole 6 of other separate part, for example 4 and/or 5 of the first group 1. Herewith, the installation (insertion) of the axis 7 can be carried out from any side of the unit which is being assembled. By means of installing the axis, the separate parts 12, 13, 14, 15 of the second group 2 of the unit are wedged in all directions perpendicularly to the axis 7 and along separate parts 12, 13, 14, 15 of the second group 2. Herewith, fixing of the axis 7 with the parts of the first group with the parts of the second group into a single unit is achieved. Due to the mentioned new features of the claimed method of connection, the technical result is achieved, namely the new features of the claimed method assure the convenient and quick assembly of the unit and herewith, allow to fix the whole unit rigidly enough without the use of glue or other additional fixation elements and/or substances.

It turned that the inventiveness of the claimed method is in that the new features of this method in a set with the prior art features, including the set of new features in implementing this method, allow thin enough axis 7 (with no more than 2 mm in diameter) to "stretch" through the whole unit with many parts of the first group unexpectedly easily and quickly by means of inserting the axis 7 into aligned central holes 6 of the parts of the first group and through the central axial clearance 21, which is formed with central protrusions 18 of the parts of the second group. Herewith the length of total axial space of the unit may be 20-25 times greater than a diameter of the axis 7. This is likely to be achieved due to the fact that during installation (insertion) of the axis 7 into the central axial clearance 21, the pressing of this axis 7 is occurred only with the internal planes of the central protrusions 18, which in turn form the central axial clearance 21, and fixing (retention) the axis 7 in the center is occurred by means of centering (alignment) and fixing the parts of the second group in rectangular connecting holes 8, 9, 10, 11 of the parts of the first group 1 which are occurred during the connection—fixing the parts of the unit and wedging the parts of the second group by the axis 7. Respectively, during the connection of all parts of the unit the alignment of separate parts 12, 13, 14, 15 of the second group 2 in a position parallel to each other by the axis 7 is occurred, and as a consequence of such technological action the steady wedging of the parts of the second group 2 at opposite edges of the unit is ensured. I.e. not the assembled unit provides the steady centered common axial corridor (axial space) for the installation of the axis 7, but the axis 7 itself aligns the unit in the process of connection the parts of the unit, "aligns" the central holes 6 of the parts of the first group 1 with a central axial clearance 21 and fixes the whole construction, interacting herewith at a tangent only by a small part of its surface with a small part of the surface of separate parts of the unit—with the central protrusions 18 of parts of the second group 2. Herewith, during the installation of the axis 7 into the unit, the central protrusions 18 on separate parts 12, 13, 14, 15 of the second group 2 "route" the movement of the axis 7 in two directions allowing a user without special skills to stretch the axis 7 at once through several central holes easily and quickly which allows respectively to carry out the assembly of the unit more conveniently and quickly and herewith, fix the whole unit rigidly enough without the use of glue or other additional fixation elements and/or substances.

Achievement of the technical result for the claimed method is strengthened in that in some cases of implementation of this method during connecting all parts of moving elements of the unit of a mechanical model, the connection (fixing) of the parts 3, 4, 5 of the first group 1 and the parts 12, 13, 14, 15 of the second group of parts 2 in the whole unit is additionally strengthened by linking the edges of no less than two connecting holes 8, 9, 10, 11 with fixation protrusions 19, 20 that are disposed at the ends of each of the separate parts 12, 13, 14, 15 of the second group 2.

Also in some embodiment of the claimed method, achievement of the technical result is strengthened due to the use of the longitudinal slots 22 on the protrusions of separate parts 12, 13, 14, 15 of the second group 2 that assures tightness of connection of separate parts 12, 13, 14, 15 of the second group 2 with separate parts 3, 4, 5 of the first group of parts 1.

Thereby, the technical result is achieved due to implementation of the claimed objects—the unit and the method of connecting the unit's parts, which are united by a single creative idea, and new features of which allow to get the new construction of the unit and the new method of connecting the parts of this unit with new properties.

During the creation of the claimed inventions in order to achieve the technical result it required to create a new set of elements of the unit, their interrelations, shapes, a new set of technological operations in the method of connecting the unit's parts, which allowed to receive inventive effect during the implementation and use of these technological decisions. The inventiveness of achievement of the technical result during implementation of the claimed technical decisions is also caused by achievement of the qualitatively new property of the construction of the unit and the method of connecting the unit's parts—due to the new set of all elements of the unit, including its new elements, and due to the new set of operations in the method of connecting the unit's parts, including its new operations, the convenience and quick assembly of the claimed unit, rigid fixing the whole unit without the use of glue or other additional fixation elements and/or substances are achieved.

PRACTICAL EMBODIMENT

Brief Description of the Drawings

Practical embodiment of the claimed unit is characterized by the drawings (FIG. 1 -FIG. 11) and the description of the construction of the unit in a static condition, its assembly and use.

The claimed technical decisions are illustrated with the following graphics—the figures of the drawings 1, 2, 3, 4, 5, 6, 7, 8, 9, 10, 11:

ELEMENTS OF THE INVENTION ARE INDICATED WITH THE FOLLOWING REFERENCES

Figure 1:
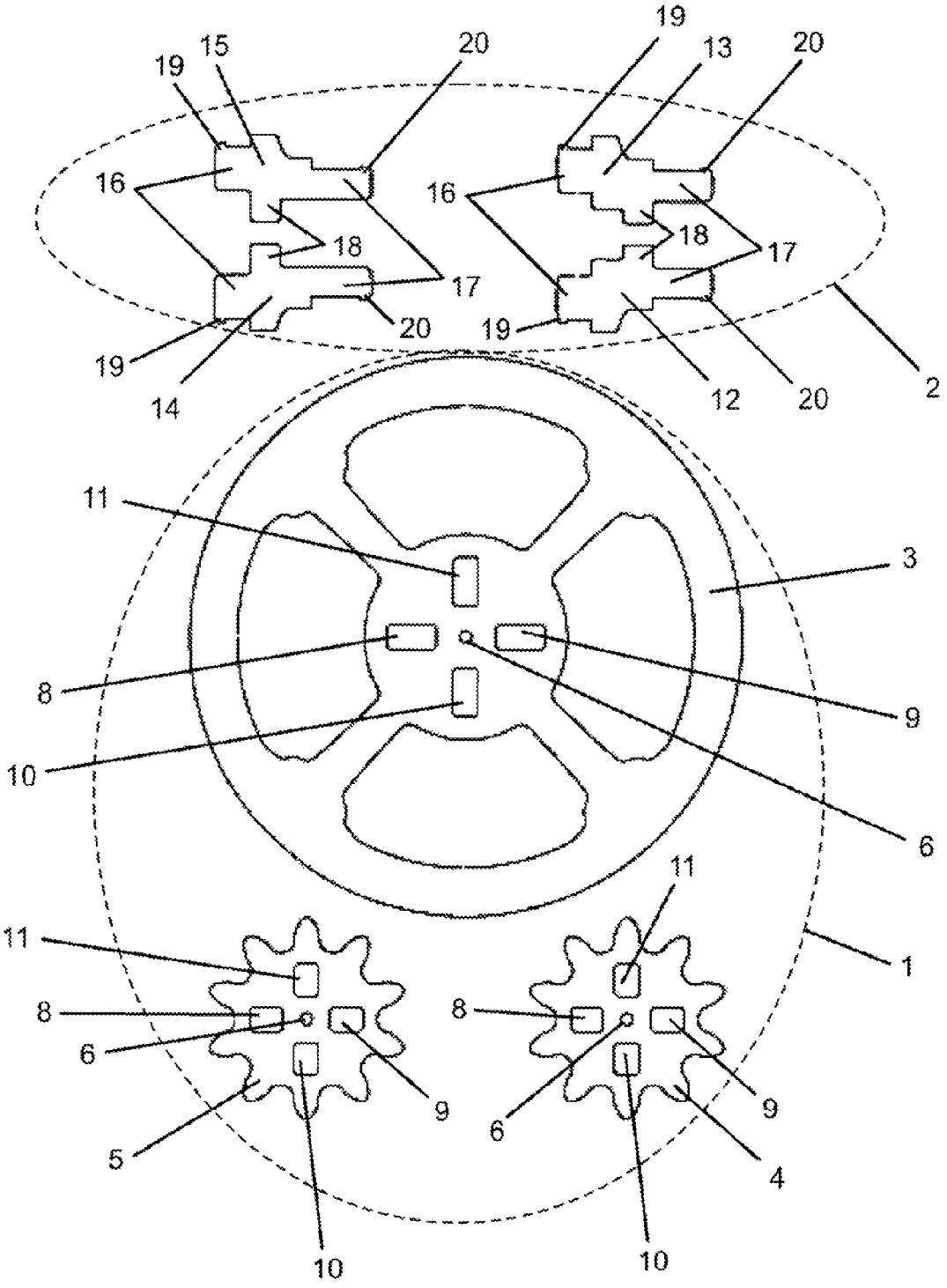
FIG. 1 shows planimetric images of the parts of the first group 1 and the second group 2.
Figure 2:
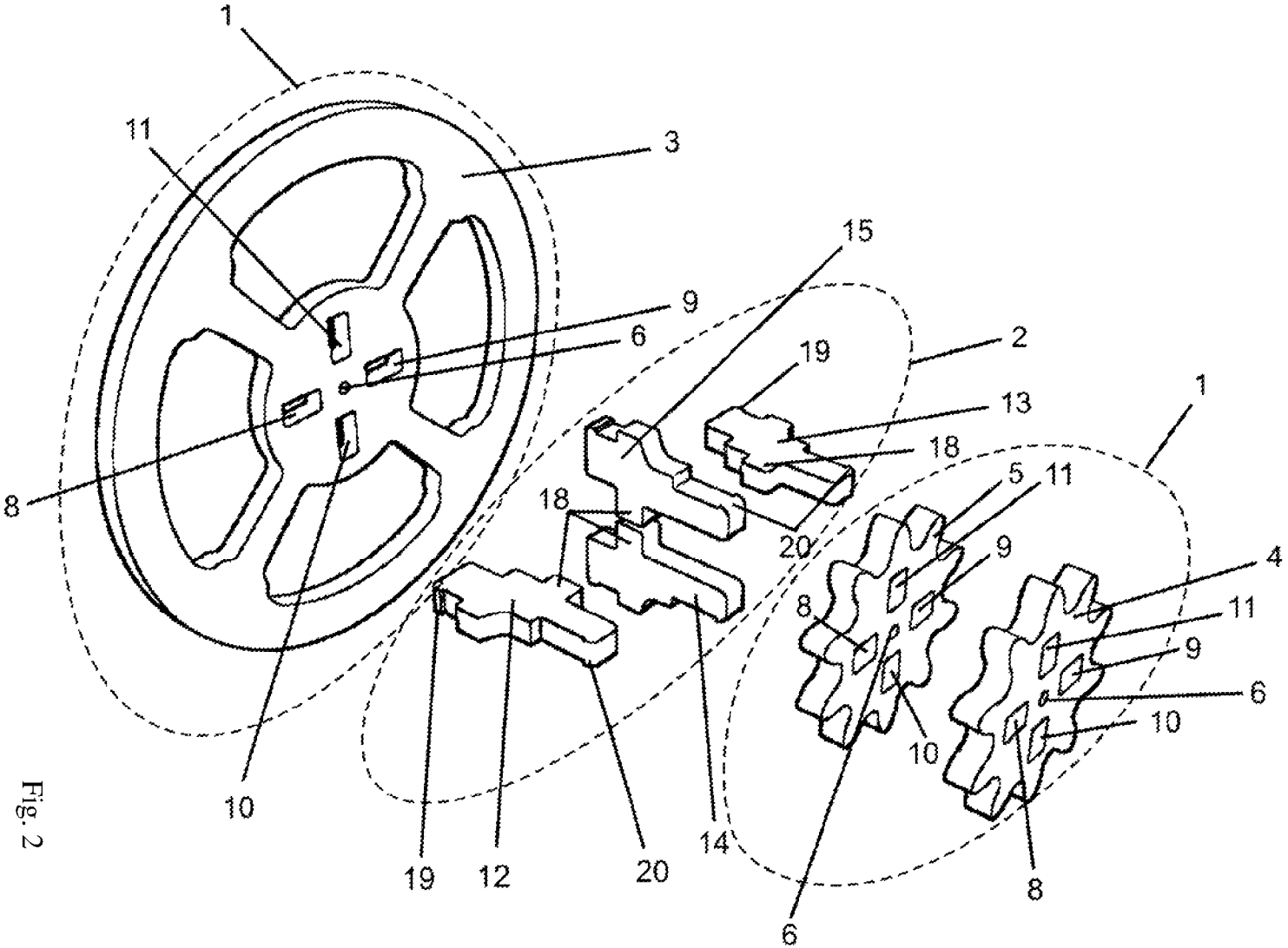
FIG. 2 shows volumetric (three-dimensional) images of the parts of the first group 1 and the second group 2.

1—the first group of parts (outlined on the FIG. 1 and FIG. 2 with dash-dot line);

2—the second group of parts (outlined on the FIG. 1 and FIG. 2 with dash-dot line);

3—a separate part of the first group of parts 1;

4—a separate part of the first group of parts 1;

5—a separate part of the first group of parts 1;

6—the central hole of separate parts 3, 4, 5 of the first group of parts 1;

7—axis

8, 9, 10, 11—connecting holes of separate parts 3, 4, 5 the first group of parts 1;

12, 13, 14, 15—separate pairwise-symmetric parts of the second group of parts 2;

16, 17—protrusions at the opposite edges of separate parts 12, 13, 14, 15 of the second group of parts 2;

18—central protrusion in the central sections of separate parts 12, 13, 14, 15 of the second group of parts 2;

19, 20—fixation protrusions at the ends of each from separate parts 12, 13, 14, 15 of the second group of parts 2;

21—a central axial clearance which is formed during the assembly between separate parts 12, 13, 14, 15 of the second group of parts 2;

22—slots on protrusions of each of the separate parts 12, 13, 14, 15 of the second group of parts 2.

DESCRIPTION OF THE PREFERRED EMBODIMENT OF THE INVENTION

The practical embodiment of the claimed unit and the claimed method of connecting the unit's parts is characterized with the following description.

Figure 3:
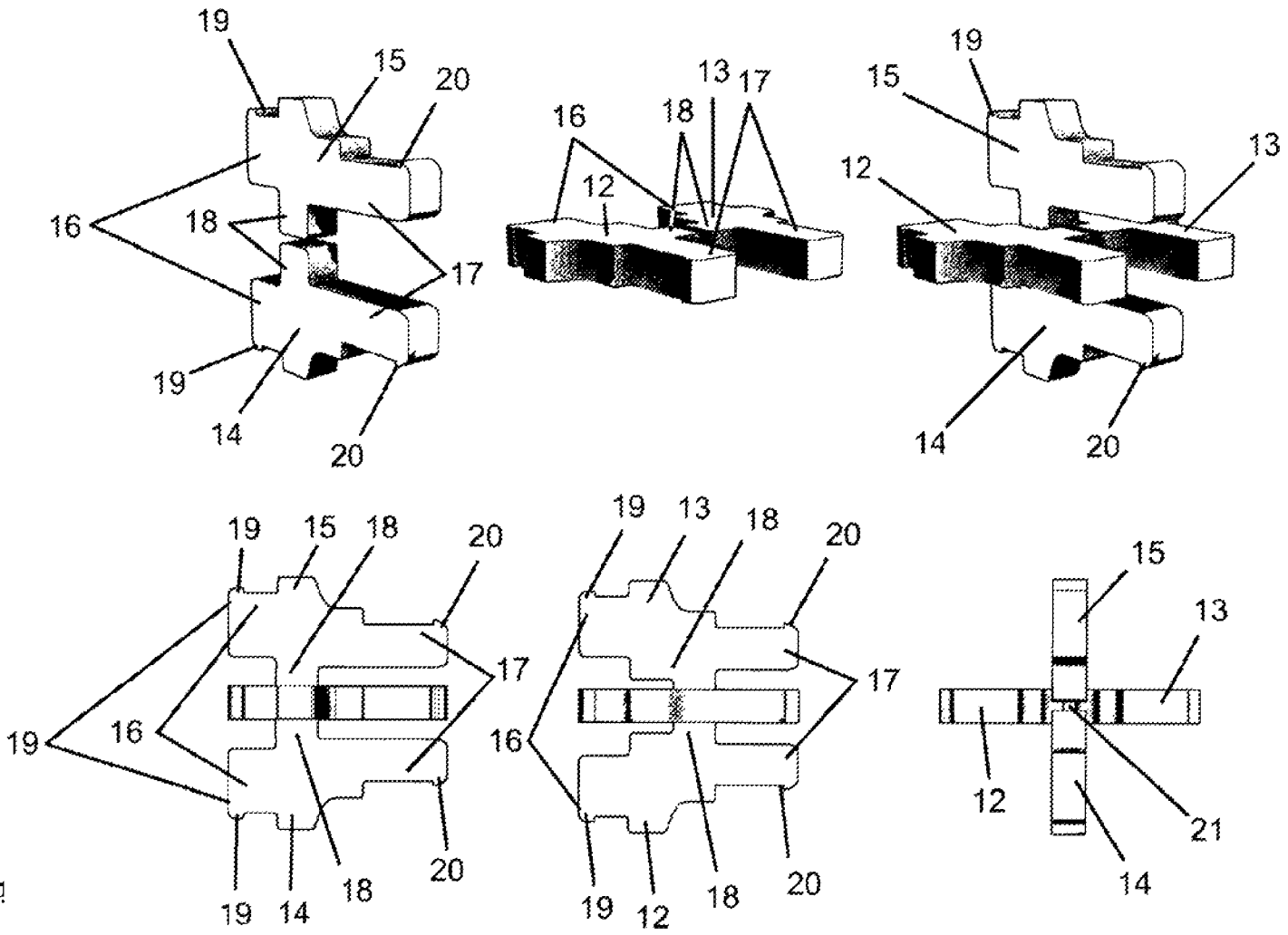
FIG. 3 shows images of the parts 12, 13, 14, 15 of the second group 2, with protrusions 16, 17, with the central protrusions 18, with formed central axial clearance 21: the volumetric (three-dimensional) images and the kinds from different sides
Figure 8:
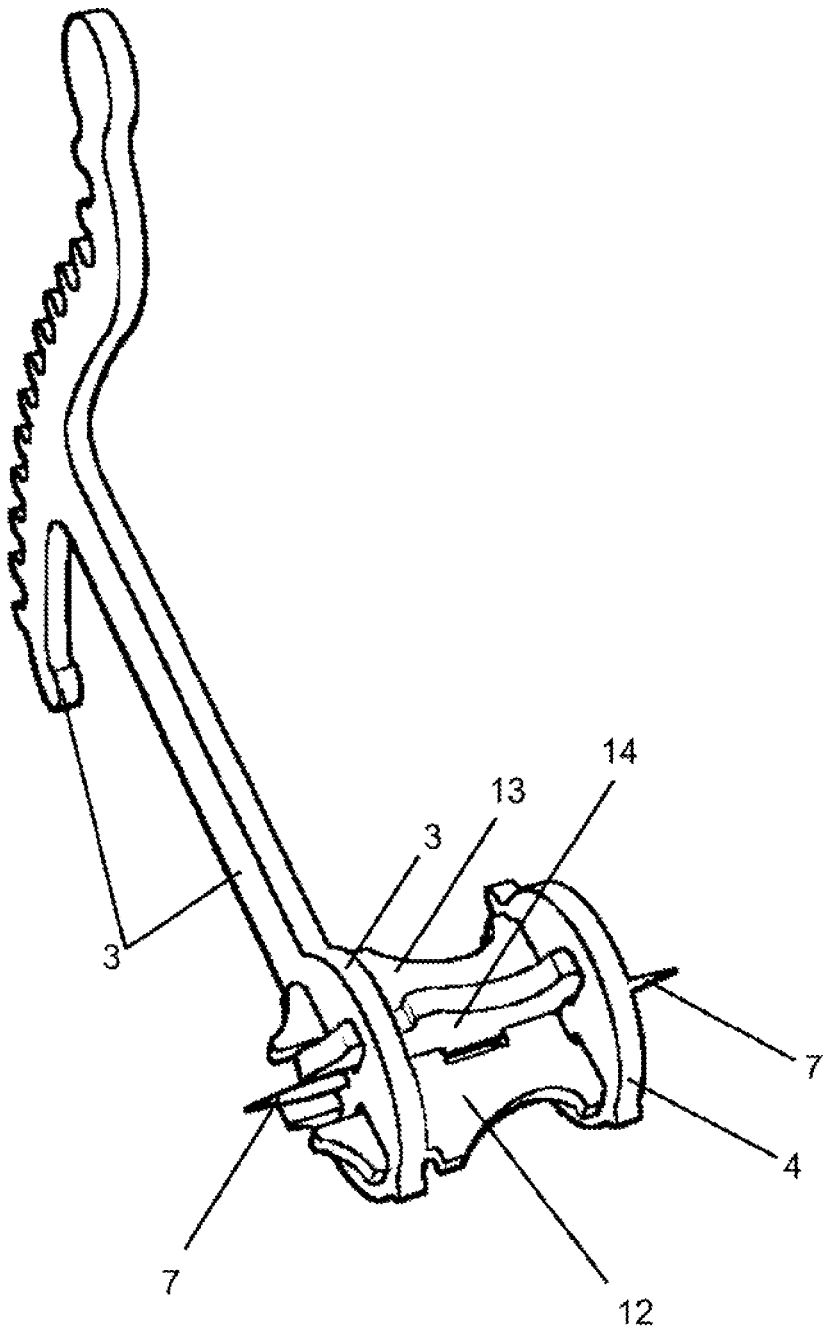
FIG. 8 shows an example of the unit in assembled condition (the first group of the parts 1 and the second group of the parts 2 in assembled state with inserted axis 7)
Figure 10:
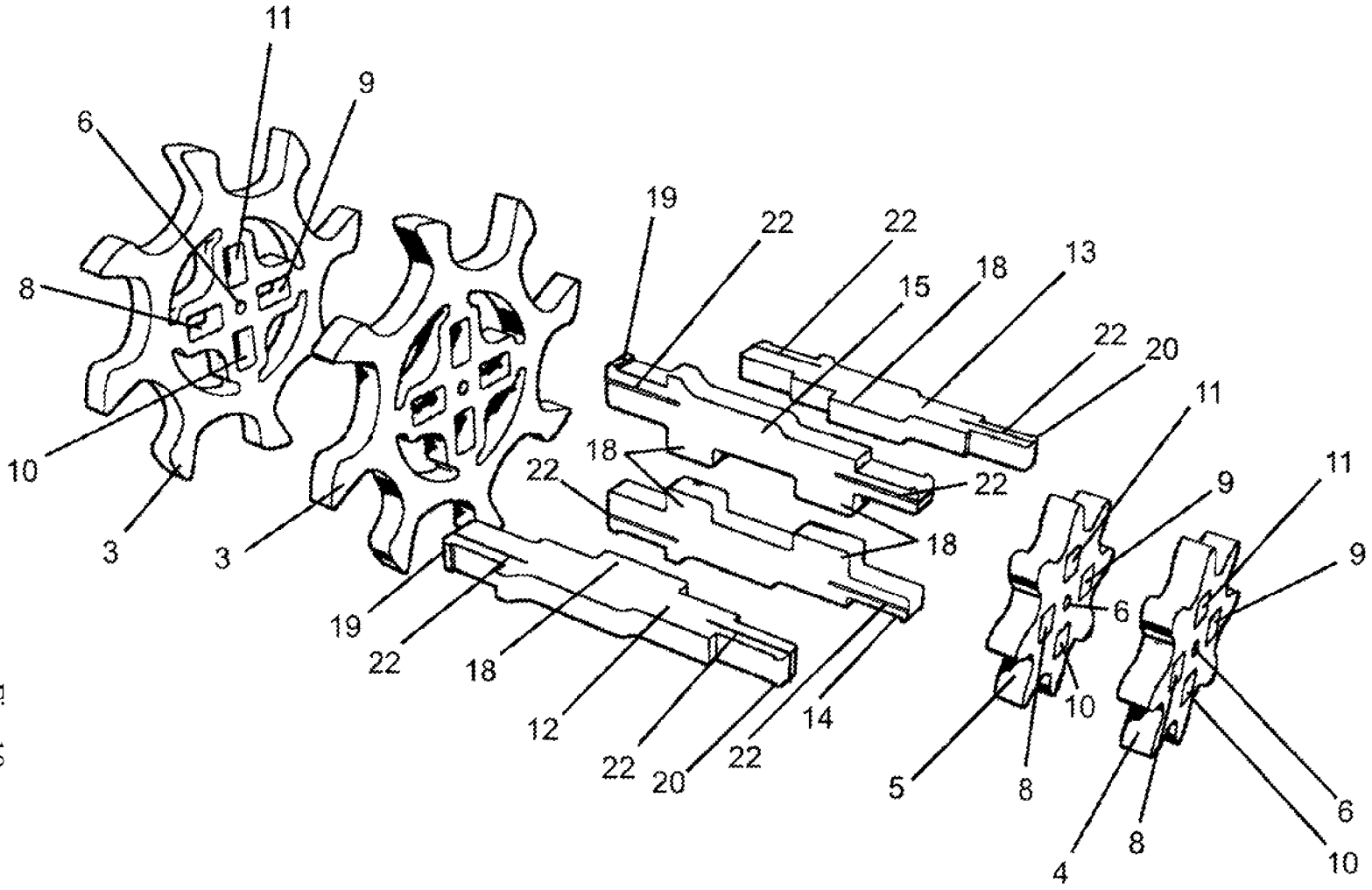
FIG. 10 shows an example of the first group of parts 1 and the second group of parts, before their assembly, where separate parts of the second group 2 are made with slots 22.
Figure 11:
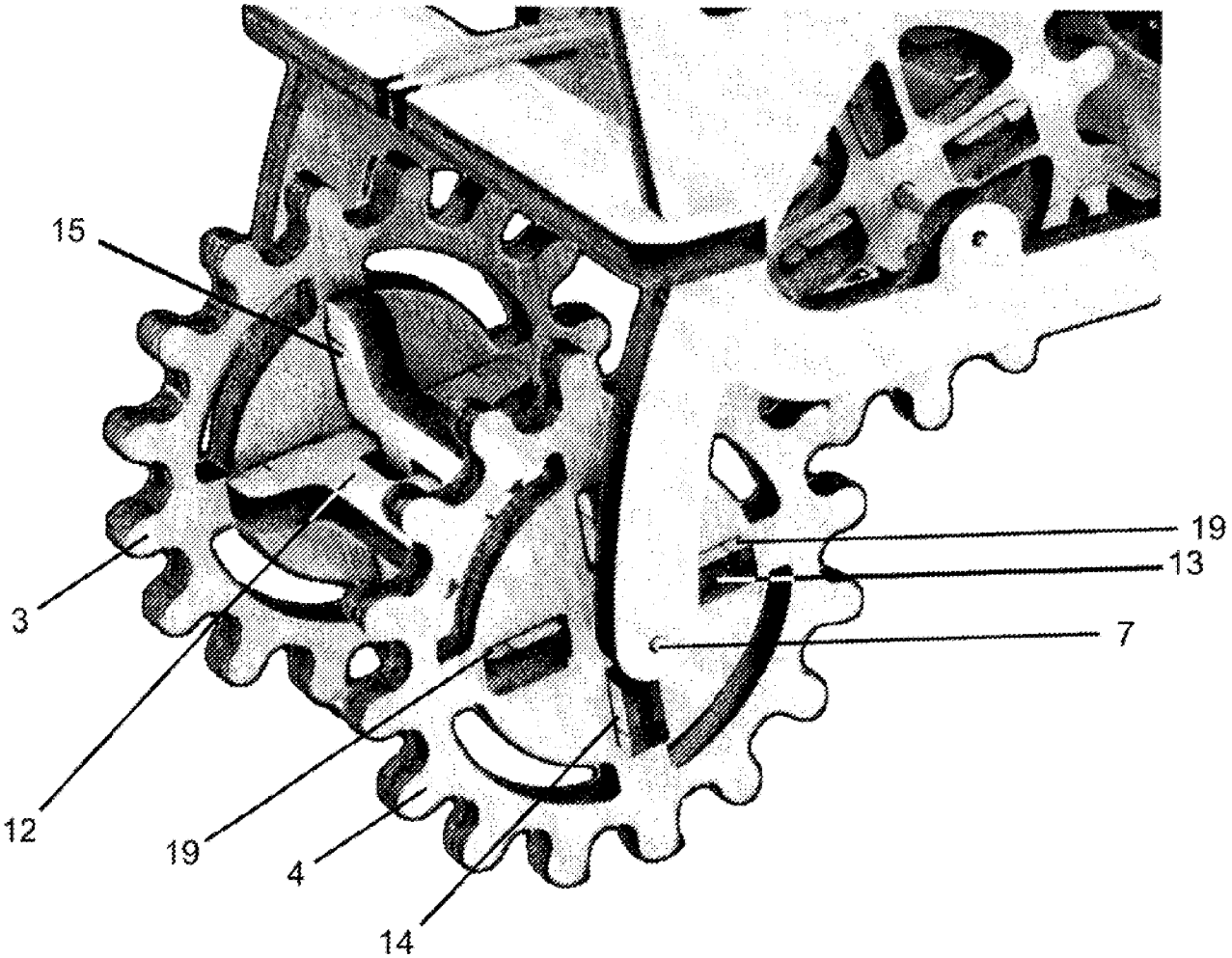
FIG. 11 shows an example of use of the claimed assembled unit, which is set in a mechanical model.

Static condition. The claimed unit comprises the first group of parts (FIG. 1, FIG. 2) and the second group of parts (FIG. 1, FIG. 2, FIG. 3). The first group of parts 1 comprises no less than two separate parts 3, 4, 5. FIG. 1. FIG. 2, FIG. 4-7 show three separate parts 3, 4, 5 of the first group of parts 1 as the examples. FIG. 8. FIG. 11 show two separate parts 3, 4 of the first group of parts 1. FIG. 10 shows four separate parts 3, 4, 5 of the first group of parts 1, where the quantity of the parts 3 is two. Each of these separate parts 3, 4, 5 of the first group of parts 1 comprises a central hole 6 (FIG. 1, 2, 4, 5, 10) for insertion (installation) an axis 7 into this central hole.

Each of separate parts 3, 4, 5 of the first group of parts 1 comprises no less than two rectangular connecting holes 8, 9, which are disposed symmetrically in relation to the center hole 6 on each of the separate parts 3, 4, 5 of the first group 1 (FIG. 1, 2, 10). In some embodiments of the unit's construction each of separate parts 3, 4, 5 of the first group 1 comprises three or four connecting holes 8, 9, 10, 11. FIG. 1, 2, 10 show four connecting holes 8, 9, 10, 11 as an example.

The second group of parts 2 comprises no less than two separate parts 12, 13, which are pairwise symmetric. In some embodiments of the claimed unit, the second group of parts 2 comprises three parts—12, 13, 14 or four separate parts 12, 13, 14, 15. FIG. 1, 2, 3, 4, 10 show four separate parts 12, 13, 14, 15 of the second group of parts 2 as an example. Each of these separate parts 12, 13, 14, 15 of the second group of parts 2 comprises protrusions 16, 17 (FIG. 1, 3) at the opposite edges, and also each of these separate parts 12, 13, 14, 15 of the second group 2 comprises no less than one central protrusion 18 in a central section (FIG. 1, 2, 3, 9, 10). Depending on particular cases of the whole construction of the unit, the separate parts 12, 13, 14, 15 of the second group of parts 2 may have (may comprise) two central protrusions 18 on each from the separate parts 12, 13, 14, 15 (FIG. 9), or three central protrusions or, if necessary, more than three central protrusions.

Figure 5:
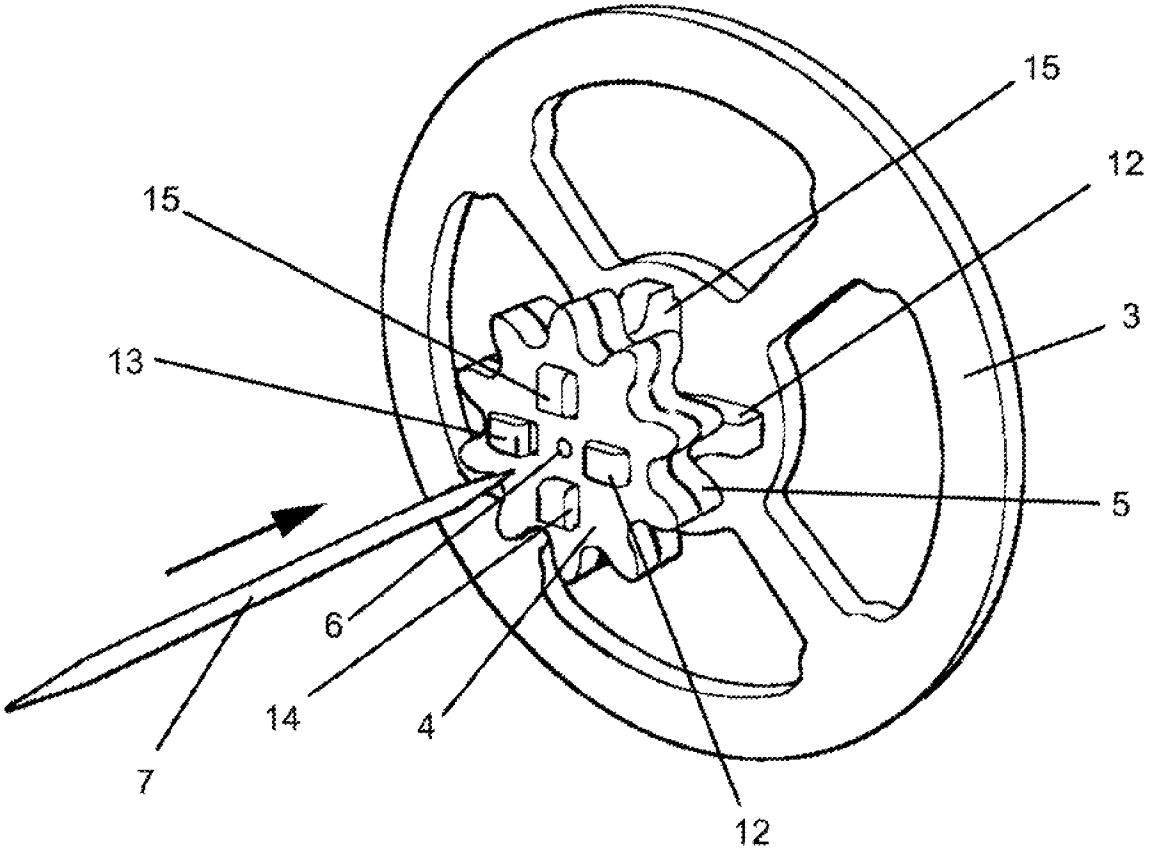
FIG. 5 shows the first group of the parts 1 and the second group 2 of the parts in assembled condition with axis 7 before its installation.

The axis 7 may have, for example, a circular cross-section and have sharpened ends (FIG. 5, 6, 7, 8). FIG. 11 shows an axis 7 which has unsharpened ends In some embodiments of the invention the fixation protrusions 19, 20 (FIG. 1, 2, 3, 4, 9, 10) may be made and disposed at the edges of each of its separate parts 12, 13, 14, 15 of the second group of parts 2.

In some embodiments of the invention the longitudinal slots 22, which are disposed along the axis line of the unit, namely—along each separate parts 12, 13, 14, 15 of the second group of parts 2, on which the longitudinal slot 22 is disposed, and along the axis line 7 (FIG. 9, FIG. 10), may be made on the protrusions of each of the separate parts 12, 13, 14, 15 of the second group of parts 2.

The first group of parts and the second group of parts are connected between each other by means of separate parts 12, 13, 14, 15 of the second group 2 thus as shown on FIG. 4, 5, 6, 7, 8. The separate parts 12, 13, 14, 15 of the second group 2 are pre-grouped (before connection with the first group of parts) and during the connection they form a central axial clearance 21 between central protrusions 18 of these separate parts 12, 13, 14, 15 second group 2 (FIG. 3). During the connection of the parts of the first group 1 and the second group of parts 2, the protrusions 16, which are disposed on one side at the edges of separate parts 12, 13, 14, 15 of the second group 2, are installed into no less than two rectangular connecting holes 8, 9, 10, 11 of one from separate parts 3 of the first group 1, and other protrusions 17, which are disposed on the other side at the edges of separate parts 12, 13, 14, 15 of the second group 2, are installed into no less than two rectangular connecting holes 8, 9, 10, 11 of other separate part 4 and/or 5 of the first group 1 (FIG. 3 and FIG. 10 show the disposition of all parts of the first group 1 and the parts of the second group 2). The axis 7 is inserted (is installed) into the central hole 6 of one of separate parts 3 of the first group 1 and into the central axial clearance 21 formed between central protrusions 18 of separate parts 12, 13, 14, 15 of the second group 2, and also into the central hole 6 of other separate part 4 (or two other separate parts 4, 5) of the first group 1 (FIGS. 5, 6, 7, 8)

The practical embodiment of the claimed unit envisages the assembly (installation) of all parts of this construction, and in the assembled state this unit is susceptible of industrial application (industrially applicable) as a construction's element in the composition of the game and souvenir sets, constructors, models of which are being built by means of connection, assembly and mounting of set of parts. The parts of the first and second group may be cut out (made) from a sheet material with thickness of several millimeters or can be made in another way, in particular by casting or molding. The axis 7 can be made in any economically and ergonomically reasonable way from any kinds of materials which are economically and ergonomically reasonable for use (e.g. from wood or plastic). On practice as the axis 7 it is possible to use, for example, an ordinary wooden toothpick or similar element which can be made from wooden material and which has low enough cost, which in general will also reduce the total cost of the product, in which the claimed unit is used.

For use of the claimed invention all indicated parts, elements have to be united into a single unit by means of connecting and fixing between each other manually, i.e. a user of the unit independently carries out mounting and connecting all parts of the unit by means of manual assembly as follows.

The example of assembling and connecting all parts into the single unit is an example of practical embodiment of the claimed method.

Stages, embodiment of the claimed method are illustrated also on FIGS. 2, 3, 4, 5, 6, 7, 8, 10.

The claimed method of connecting the parts of separate moving elements of the unit of a mechanical model, which are able to rotate about a single axis, envisages carrying out the operations of connection of parts between each other by means of installation of some parts into connecting hole of other parts and further fixing all parts into the single unit of a mechanical model.

The users carry out the connection of the parts of the first group and the parts of the second group between each other manually by means of performing the connecting operations.

Figure 6:
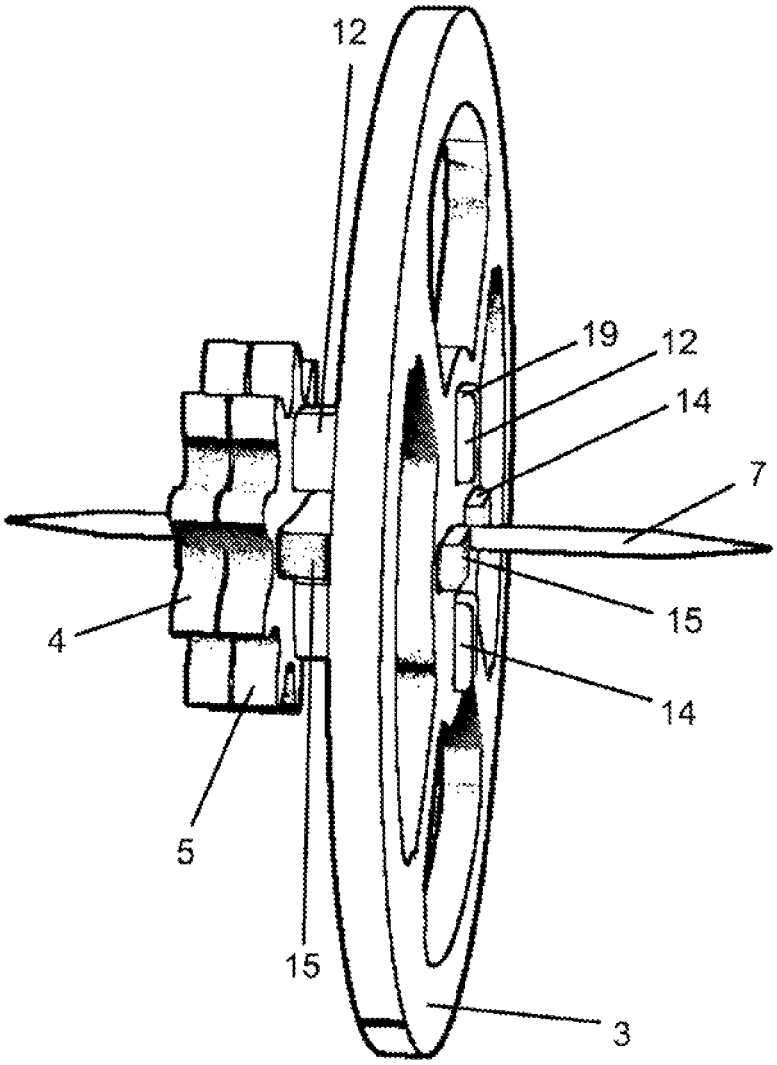
FIG. 6 shows an example of the unit in assembled state (the first group of the parts 1 and the second group of the parts 2 in assembled condition with the inserted axis 7)
Figure 7:
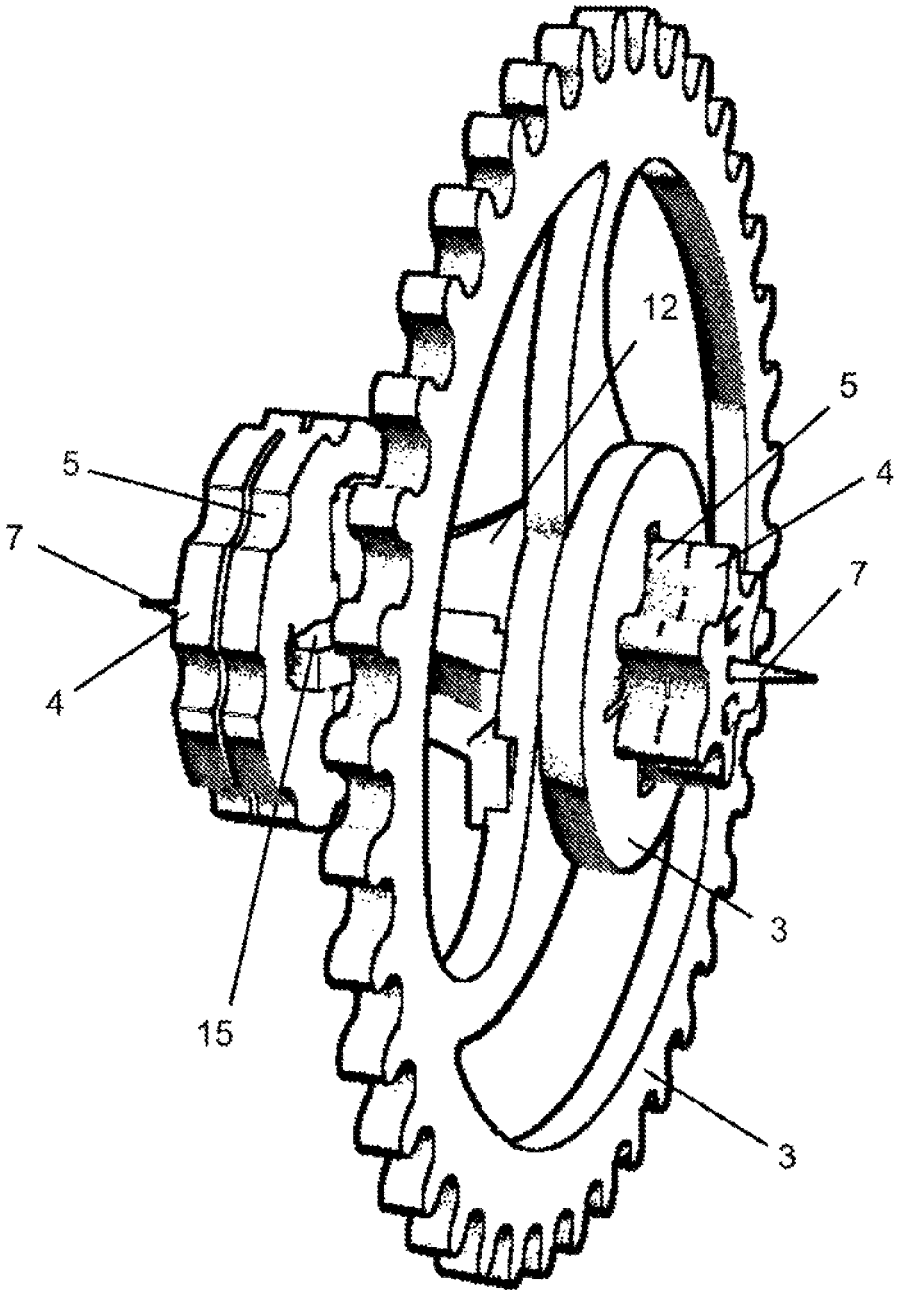
FIG. 7 shows an example of the unit in assembled state (the first group of the parts 1 and the second group of the parts 2 in assembled condition with the inserted axis 7)

The connecting operations are carried out with the use of the axis 7 and two groups of parts 1 and 2. FIG. 2, 3, 4, 5, 6 show an example of connecting parts of separate moving elements of the unit of a mechanical model, where is envisaged three parts (3, 4, 5) of the first group 1 and four parts (12, 13, 14, 15) of the second group 2 as well as the axis 7 (FIGS. 5, 6). In this example (FIGS. 2, 3, 4, 5, 6) during connecting and mounting, the parts 12, 13, 14, 15 of the second group 2 are actually perpendicularly disposed between the part 3 of the first group of parts 1 and the parts 4, 5 also of the first group of parts. Also this is shown on the FIG. 10 but with the use of two parts 3 of the first group 1.

Figure 4:
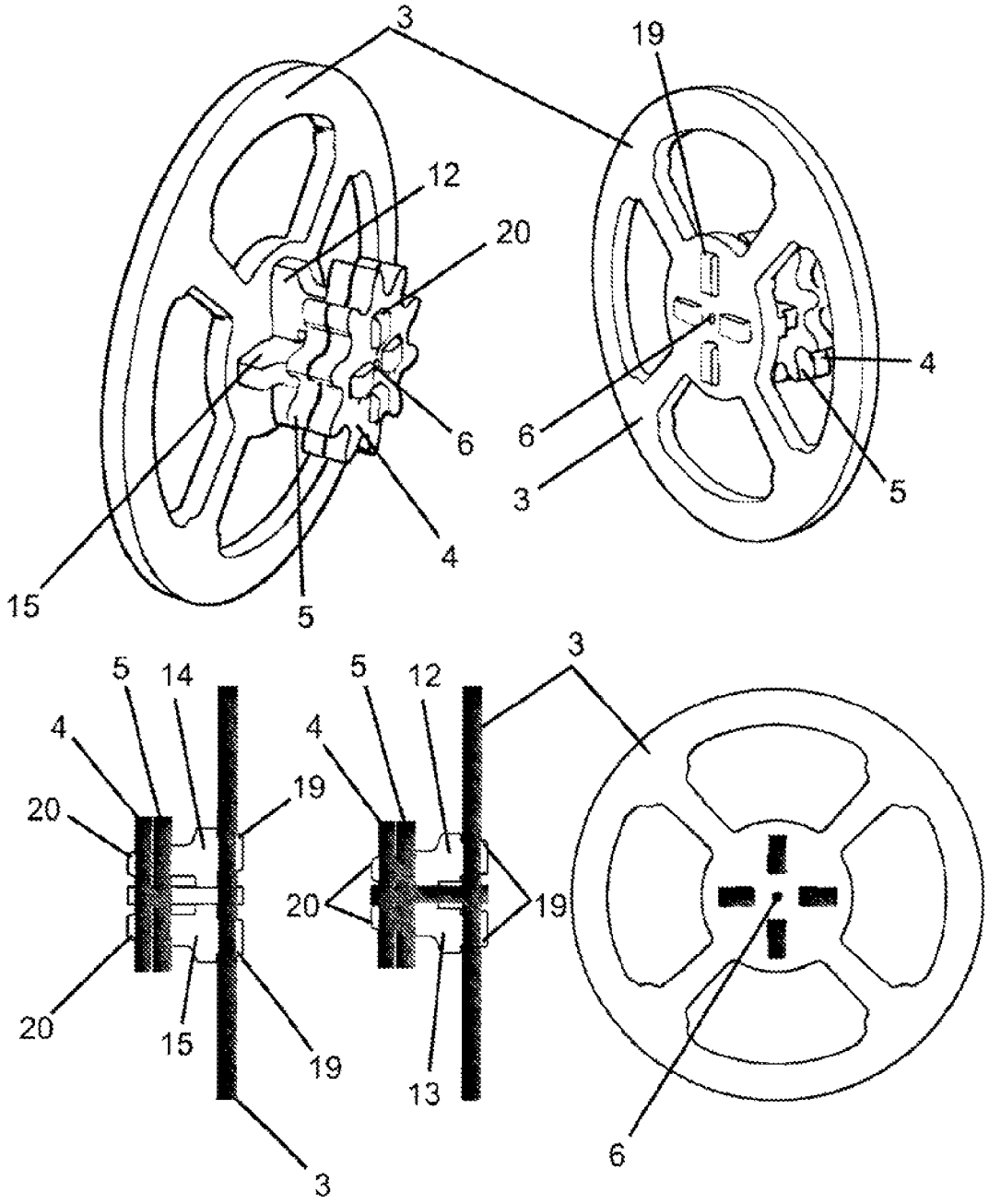
FIG. 4 shows the first group of the parts 1 and the second group 2 of the parts in assembled condition without inserted axis 7.

Thereby, the first group of parts and the second group of parts are connected sequentially between each other by means of insertion (installation) of protrusions 16, which are disposed at the opposite edges of no less than two separate parts, and in the given example at the opposite edges of four separate parts 12, 13, 14, 15 of the second group of parts 2, into no less than two (and in the given example into four) rectangular connecting holes 8, 9, 10, 11 of one of separate parts 3 of the first group 1. Also other protrusions 17, which are disposed at other opposite edges of no less than two, and in the given example—at other opposite edges of four separate parts 12, 13, 14, 15 of the second group of parts 2, are inserted into no less than two (in the given example—into four) rectangular connecting holes 8, 9, 10, 11 of other separate part of the first group 1 (FIG. 2, FIG. 4).

Installation of protrusions 16 and 17 of separate parts 12, 13, 14, 15 of the second group 2 into connecting holes 8, 9, 10, 11 of separate parts 3, 4, 5 of the first group 1 can be carried out successively (in any order) and almost simultaneously, i.e. it does not matter in what sequence the user will carry out such installation and connecting the parts of the first group 1 and the parts of the second group 2.

After such connection, the central axial clearance 21 (FIG. 3) is formed between central protrusions 18 of separate parts 12, 13, 14, 15 of the second group 2, after which the axis 7 is inserted into the central hole 6 of one of separate parts 3 of the first group, into the central axial clearance 21, which is formed between central protrusions 18 of separate parts 12, 13, 14, 15 of the second group 2, and into the central hole 6 of other separate part 4 of the first group 1 (and in the given example—into central holes 6 of two separate parts 4, 5 of the first group of parts 1) (FIG. 5). Also a user can carry out the insertion (installation) of the axis 7 first into the central holes 6 of separate parts 4, 5 of the first group 1 and then into the central axial clearance 21 formed between central protrusions 18 of separate parts 12, 13, 14, 15 of the second group 2, after which a user carries out the insertion (installation) of the axis 7 into central hole 6 of one of separate parts 3 of the first group 1.

During the installation and connecting all parts of the unit before the moment of insertion of the axis 7 into the central holes 6 of the parts 3, 4, 5 of the first group and into the formed axial clearance 21, there is a backlash in the places of connection of the unit's parts, and the whole assembled construction is not finally fixed, i.e. a user holds not yet fully assembled unit manually. Respectively, by means of insertion of the axis 7 into the central holes 6 of separate parts 3, 4, 5 of the first group of parts 1 and into the central axial clearance formed between central protrusions 18 of separate parts 12, 13, 14, 15 of the second group 2, the separate parts 12, 13, 14, 15 of the second group 2 are wedged by this axis 7 in all directions perpendicularly to the axis 7 and along separate parts 12, 13, 14, 15 of the second group 2, as well as fixing the axis 7 with the parts of the first group 1 and the parts of the second group 2 into the single unit (FIGS. 4, 5, 6, 7, 8, 11) are achieved.

Due to the feature of the unit's construction and the method of connecting its parts a diameter of central holes 6 of the parts of the first group allows a free movement of the axis 7 through these holes 6, and the planes of inner central protrusions 18 of separate parts 12, 13, 14, 15 of the second group 2 (which form a central axial clearance 21) may have minimum contact with the axis 7, which allows the axis 7 easily enough, smoothly and gradually move forward through all the holes 6 and through the central axial clearance 21 of the unit, and at the same time, the axis 7 wedges the separate parts 12, 13, 14, 15 of the second group 2 of the unit with sufficient force Thereby, the separate parts 12, 13, 14, 15 of the second group are wedged by means of the axis 7 in all directions perpendicularly to the axis 7, which allows to fix the whole unit rigidly enough without the use of glue or other additional fixation elements and/or substances, and to use the ready fixed unit in the composition of the game and souvenir constructor sets, including in the volumetric models with moving parts and/or the mechanical 3D-puzzles and in other similar constructions.

A ready fixed unit can be disassembled effortlessly. This opportunity of effortless disassembling of all parts of the unit is appeared only after the full extraction of the axis 7 from the axial space of the unit, which is formed by the central holes 6 of the first group of parts 1 and the axial clearance 21, i.e. after extraction of the axis 7 there is a clearing all parts of the first group 1 and parts of the second group 2 of the unit from the radial forces (wedging forces), and thereby, all parts of the unit can be easily disassembled and disconnected.

In certain embodiments of the method, during the connection (fixing) of all parts of separate moving elements of the unit of a mechanical model, after the insertion (installation) of the axis 7 into the central holes 6 of the parts of the first group 1 and into the formed axial clearance 21, connecting and fixing the parts of the first group and the parts of the second group into the single unit is additionally strengthened and provided by means of hooking and "latching" the edges of no less than two, and in the given example (FIGS. 3, 4, 9) four connecting holes 8, 9, 10, 11 of the parts of the first group 1 with fixation protrusions that are disposed at the ends of each of the separate parts 12, 13, 14 15 of the second group 2, and thereby, fixation all parts of the unit (FIGS. 4, 6, 11) is additionally strengthened.

Figure 9:
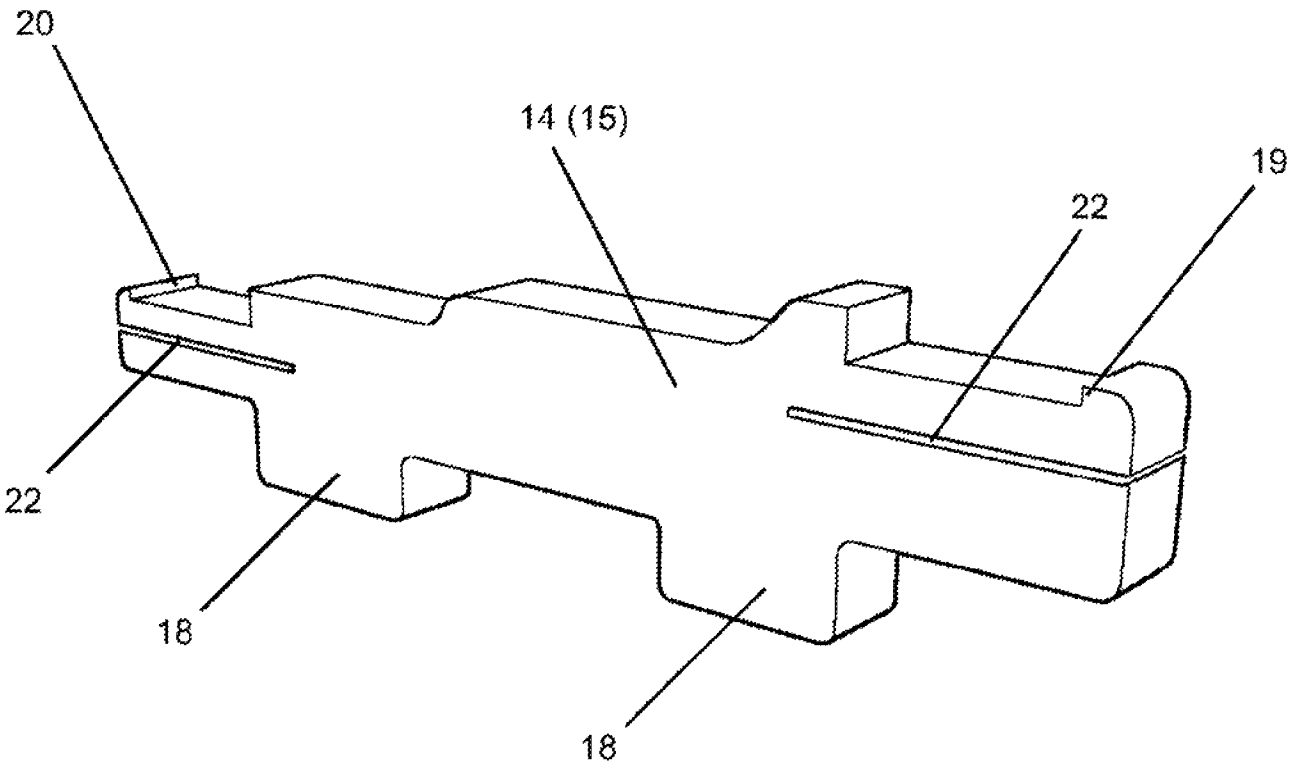
FIG. 9 shows an example of a separate part of the second group 2 with slots 22.

In certain embodiments of the method, by means of use of the longitudinal slots 22 on protrusions of each from the separate parts 12, 13, 14, 15 of the second group 2, the tightness of connection of separate parts 12, 13, 14, 15 of the second group 2 with separate parts 3, 4, 5 of the first group 1 is assured (FIG. 9, FIG. 10).

The longitudinal slots 22 are disposed along each of separate part 12, 13, 14, 15 of the second group 2, on which the longitudinal slot 22 is made, and along the axis line of the unit (FIG. 9, FIG. 10). The longitudinal slots 22 are designed to improve and facilitate the process of implementation of the method of connecting the unit's parts. The longitudinal slots 22 allow the material, from which the separate parts 12, 13, 14, 15 of the second group 2 are made, to amortize better during wedging of these separate parts 12, 13, 14, 15 with the axis 7, i.e. each of these longitudinal slots 22 is reduced maximally under physical pressure during the insertion (installation) of the separate parts 3, 4, 5 into connecting parts 8, 9, 10, 11 of the first group 1, that allows the material of the parts 12, 13, 14, 15 of the second group 2 to abut upon and pull over to the connecting holes 8, 9, 10, 11 of separate parts 3, 4, 5 of the first group 1 more "softly". The edges of separate parts 12, 13, 14, 15 of the second group 2 by means of longitudinal slots 22 are divided into two parts and one part—a strip of the material is formed, which is more flexible because it is thinner, herewith it doesn't break because it is supported by other strip—the part of separate parts 12, 13, 14, 15 of the second group 2, which has bigger thickness. Herewith, due to the longitudinal slots 22 during implementation of the method, the flexibility of separate parts 12, 13, 14, 15 of the second group 2 is increasing that allows to strengthen the possibility to achieve the technical result.

Thereby, the claimed method of connecting the unit's parts can be embodied only in the presence of the claimed unit, its parts, and the claimed unit is designed (is intended) for implementation of the claimed method of connecting its parts.

The claimed unit of separate moving elements of a mechanical model, which are able to rotate about a single axis, and the method of connecting the parts of separate moving elements of the unit of a mechanical model, which are able to rotate about a single axis had passed through extensive testing in the composition of the gaming and souvenir sets (constructors), in particular in the volumetric models with moving parts, in the mechanical 3D-puzzles and in other constructions.

The results of testing show that the claimed unit and method of connecting its parts allow to carry out the assembly of the unit more conveniently and quickly and herewith allow to fix the whole unit rigidly enough without the use of glue or other additional fixation elements and/or substances.

The claimed unit and method of connecting the parts meet all the requirements of their exploitation and application. The production of the claimed unit of separate moving elements of a mechanical model, which are able to rotate about a single axis, in conjunction with implementation of the method of connecting its elements (parts) allow to expand the range of modern gaming and souvenir constructors, technologies of their assembly.

INDUSTRIAL APPLICABILITY

The claimed invention is susceptible of industrial application (is industrially applicable)—according to the claimed technical decisions, the claimed unit and the claimed method of the unit's assembly can be implemented in industrial production and can be widely used as intended.

The example of particular industrial application of the claimed invention and its use is given above as the best embodiment of the invention.

The claimed technical decisions are widely tested in the experimental-industrial conditions. The results of these tests showed the achievement of the technical result when using them.

What is claimed is:

1. A mechanical model unit of parts rotatable around an axis, comprising:

an axle, a first group of parts and a second group of parts;

wherein the first group of parts including at least two parts, and each of the at least two parts of the first group of parts having a central axle hole and at least two rectangular connecting holes, the at least two rectangular connecting holes are disposed symmetrically in regard to the central axle hole on each of the at least two separate parts of the first group, the second group of parts including at least two parts which are axially symmetric, the at least two parts of the second group of parts having an elongated shape with protrusions at opposite far ends and at least one central protrusion in a central section facing the axle, the at least two parts of the first group of parts are coupled together by the at least two parts of the second group of parts, the protrusions of the at least two parts of the second group disposed at one far end are inserted into the at least two rectangular connecting holes of one of the at least two parts of the first group, the protrusions of the at least two parts of the second group disposed at another far end are inserted into the at least two rectangular connecting holes of another of the at least two parts of the first group, and the axle pathing through the central axle hole of the at least two parts of the first group and in between the at least two parts of the second group with the central protrusions resiliently engaging the axle.

2. The mechanical model unit according to claim 1, wherein each of the at least two parts of the first group comprising three rectangular connecting holes disposed symmetrically in respect to the central axle hole, while the second group of parts comprising three parts.

3. The mechanical model unit according to claim 1, wherein each of the at least two parts of the first group comprising four rectangular connecting holes disposed symmetrically in respect to the central axle hole, while the second group of parts comprising four separate parts.

4. The mechanical model unit according to claim 1, wherein the axle has a circular cross-section and two pointed ends.

5. The mechanical model unit according to claim 1, wherein the parts of the first group and the second group are made from a material which is different from a material used to make the axle.

6. The mechanical model unit according to claim 1, wherein there are snap on fixation protrusions at the opposite far ends of each of the at least two parts of the second group.

7. The mechanical model unit according to claim 1, wherein longitudinal slots are made in the protrusions of the at least two parts of the second group, the longitudinal slots are parallel to the axle.

8. A method of connecting parts of a mechanical model unit rotatable around an axis comprising:

providing a connection of the parts to each other by installing the parts into connecting holes of other parts, connecting an axle, a first group of parts and a second group of parts, wherein the connection of the first group of parts and the second group of parts is carried out by inserting protrusions, disposed at opposite far ends of at least two parts of the second group, into at least two rectangular connecting holes of one of at least two parts of the first group and another of the at least two parts of the first group;

a central axle clearance is formed between central protrusions of the at least two parts of the second group, the axle is inserted into a central axle hole of the one of the at least two parts of the first group, into the central axle clearance between the central protrusions of the at least two parts of the second group, and into a central hole of the another of the at least two parts of the first group; and the at least two parts of the second group are resiliently engaged with the axle in directions perpendicularly to the axle fastening the axle and the parts of the first and second group into the mechanical model unit.

9. The method according to claim 8, wherein the connection of the at least two parts of the first group and the parts of the second group into the mechanical model unit is facilitated by snap on fixation protrusions disposed at the far ends of the at least two parts of the second group.

10. The method according to claim 8, wherein longitudinal slots in the protrusions of the at least two parts of the second group facilitate snap on locking to the at least two parts of the first group.

* * * * *